United States Patent [19]

Luttringer

[11] 4,211,527

[45] Jul. 8, 1980

[54] PROCESS FOR DYEING POLYESTER MATERIALS

[75] Inventor: Jean P. Luttringer, Rixheim, France

[73] Assignee: Ciba-Geigy Corporation, Ardsley, N.Y.

[21] Appl. No.: 858,997

[22] Filed: Dec. 9, 1977

[30] Foreign Application Priority Data

Dec. 14, 1976 [CH] Switzerland ..... 15705/76

[51] Int. Cl.[2] ..... D06P 5/00; D06P 7/00

[52] U.S. Cl. ..... 8/526; 8/539; 8/620; 8/625; 8/618; 8/634

[58] Field of Search ..... 8/17, 169, 174, 179, 8/82, 84, 21 C, 92

[56] References Cited

U.S. PATENT DOCUMENTS

| | | | |
|---|---|---|---|
| 2,768,054 | 10/1956 | Armento et al. | 8/169 |
| 3,520,007 | 7/1970 | Schuster et al. | 8/82 |
| 3,925,011 | 12/1975 | Boehmke | 8/169 |

FOREIGN PATENT DOCUMENTS

| | | |
|---|---|---|
| 46-03828 | 1/1971 | Japan . |
| 938414 | 10/1963 | United Kingdom . |

OTHER PUBLICATIONS

Research Disclosure, No. 11459, Oct. 1973, p. 71.

*Primary Examiner*—A. Lionel Clingman
*Attorney, Agent, or Firm*—Edward McC. Roberts

[57] ABSTRACT

Described is a process for dyeing polyester materials, or mixtures thereof with other fibres, by the exhaust method from an aqueous liquor, in which process the liquor contains at least 0.2 percent by weight, relative to the material, of at least one alkaline-earth metal salt, aluminium salt or organic ammonium salt of a mono- or polyvalent aliphatic organic acid or of a mono- or polyvalent inorganic acid. Preferably calcium chloride or magnesium chloride are used.

14 Claims, No Drawings

PROCESS FOR DYEING POLYESTER MATERIALS

The invention relates to a process for dyeing polyester materials to obtain dyeings which are free from visible oligomer precipitations, to a dye liquor suitable for performing the process, and to the polyester material dyed by this process.

It is known that when polyester materials are dyed, particularly under high-temperature conditions, there occurs a precipitation of oligomers, an effect which can lead not only to a poorer appearance (patchy dyeings) on the surface of the fibres but also to difficulties in the further processing of the polyester material, especially during re-spooling and knitting. Furthermore, the oligomers can cause undesirable deposits in the dyeing apparatus. These oligomers form during production of the polyester fibres, and under dyeing conditions they get into the dye liquor, where they crystallise out and produce on the material to be dyed and/or in the dyeing apparatus the depositions referred to. An increased tendency for the precipitation of oligomers to occur exists when polyester material is preliminarily scoured in organic solvents at elevated temperature, particularly in perchloroethylene or trichloroethylene, and subsequently subjected to an aqueous high-temperature dyeing process.

Attempts have therefore been made to prevent this disadvantageous escape of oligomers from the material during the dyeing process. Thus, according to German Offenlegungsschrift No. 24 03 859, an attempt was made to prevent the escape of oligomers by adding emulsions of phthalic acid diesters with organic alcohols to the dye bath. The escape of oligomers under these conditions is however in most cases not sufficiently prevented.

Furthermore, according to German Patent Specification No. 2 056 694, an attempt was made to overcome the difficulties discussed in the foregoing by the addition of considerable amounts of substituted polyglycol compounds to the dye bath, a procedure, however, which did not have the desired success; on the contrary, the dye dispersion can be unfavourably affected by the addition of the polyglycol compounds in that, for example, dye precipitation can occur. In addition, an attempt was made, according to U.S. Pat. Spec. No. 3,679,349, to remove the oligomers, appearing after dyeing and being deposited on the dyed material, by rinsing processes, e.g. by an afterwashing treatment with organic solvents, particularly perchloroethylene, a process however which entails a large expenditure.

The object of the present invention was therefore to develop for polyester materials a simple dyeing process which would solve the problems which have been discussed.

It has now been found that by the addition of at least one alkaline-earth metal salt, aluminium salt or organic ammonium salt of a mono- or polyvalent aliphatic organic acid or of a mono- or polyvalent inorganic acid to the dye bath for the dyeing of polyester materials by the exhaust method from an aqueous liquor, particularly in the case of dyeing above 100° C., there is obtained a dyed material which is surprisingly free from visible oligomers (sandwich effect) on the surface.

The dye liquor contains for this purpose at least 0.2 percent by weight, preferably 0.2 to 8.0 percent by weight, and particularly 0.5 to 4.0 percent by weight, relative to the material to be dyed, of at least one salt as defined.

These salts are in particular water-soluble salts, for example the magnesium, calcium, barium, strontium, aluminium or organic ammonium salts of mono- or polyvalent inorganic acids or of mono- or polyvalent aliphatic organic acids, such as hydrochloric acid, hydrobromic acid, hydrofluoric acid, nitric acid, sulphuric acid, phosphoric acid or formic acid, acetic acid and thiocyanic acid. Such salts are, for example: calcium nitrate, magnesium nitrate, aluminium nitrate, calcium chloride, magnesium chloride, aluminium sulphate and magnesium sulphate, calcium sulphate or organic ammonium chlorides, ammonium bromides or ammonium iodides, such as methonium salts (alkane-bis-trimethylammonium salts). Examples of suitable methonium salts are pentamethonium iodide, decamethonium bromide and, in particular, hexamethonium chloride.

By salts are meant also the complexes of the aforementioned cations with mono- or polyvalent organic acids, such as ethylenediaminetetraacetic acid or nitrilotriacetic acid. These complexes have under the dyeing conditions to be at least partially dissociated.

It has proved particularly advantageous if the complexing agents are added together with the metal salts, especially alkaline-earth metal salts, of mono- or polyvalent inorganic acids to the dye bath.

The salts can be added in the solid or dissolved form to the dye liquor. They can however also be contained in the dye preparations or in the formulations of auxiliaries.

The best results are obtained with alkaline-earth metal salts, particularly with calcium and magnesium salts, of monovalent inorganic or organic aliphatic acids, especially with calcium chloride or magnesium chloride.

The aqueous dye liquor can optionally contain further auxiliaries, such as acids for adjusting the pH value, and in particular carriers. Suitable carriers are those customarily used in the dyeing of polyester with disperse dyes, e.g. phenol derivatives or benzene derivatives, such as o- or p-phenylphenol, salicylic acid, cresols, diphenyl, chlorinated benzenes such as 1,2,4- and 1,2,3-trichlorobenzene, benzophenone, benzoic acid, substitution products of benzoic acid, and also aromatic esters such as butyl-, benzyl-, cresyl- or phenylbenzoate, methylsalicylate or monobenzylphthalate. Also mixtures of these carriers can be used.

The dyes used are disperse dyes, i.e. those which are difficultly soluble in water. The usual disperse dyes can be used.

The widest variety of chemical classes of dyes are suitable, for example: nitro, aminoketone, ketoneimine, methine or polymethine dyes, nitrodiphenyleneamine, quinoline, benzimidazole, xanthene, oxazine, aminonaphthoquinone or coumarin dyes, and especially anthraquinone and azo dyes, such as mono- or disazo dyes, all these dyes being free from sulphonic acid groups.

The amounts in which these dyes are used in the dye baths can vary within wide limits depending on the desired depth of colour; in general, amounts of 0.001 to 10 percent by weight of one or more of these dyes have proved advantageous.

By polyester materials are meant polycondensates from aromatic polycarboxylic acids, especially dicarboxylic acids or derivatives thereof, and polyfunctional alcohols, particularly glycols. The polyester used in the textile industry almost exclusively up to now is that from terephthalic acid and ethylene glycol.

It is also possible to use however copolymers from teraphthalic acid and isophthalic acid with ethylene glycol. A mixture of polyester material with other fibres, for example cellulose or wool, can however also be used. These textile materials can be in the most varied stages of processing, for example in the form of piece goods, such as fabrics and knitwear, fibrous fleece materials, yarn, filaments, flocks, tow or slubbing.

The dyeing of the polyester material is performed from an aqueous dispersion, with the dispersion and/or the dye containing a dispersing agent. The dispersing agents used are, for example, anionic dispersing agents such as alkylarylsulphonates, condensation products of formaldehyde with naphthalenesulphonic acid, and also lignin sulphonates; or nonionic dispersing agents. It is also possible however to use mixtures of dispersing agents.

Dyeing is performed by the customary exhaust processes, with a ratio of goods to liquor preferably of 1:4 to 1:100, particularly 1:8 to 1:25, e.g. at temperatures above 100° C., especially at 120° to 140° C., under pressure, for about 30 to 90 minutes in an acid pH range. By ratio of goods to liquor is meant the ratio of goods in kg to liquor in liters. The dyeing can also be carried out at the boiling point of the dye bath.

By the process according to the invention there are obtained, by virtue of the addition of at least one metal salt as defined, particularly at a dyeing temperature of above 100° C. under pressure, dyeings which are free from visible precipitations of oligomers on the surface of the material, without any impairment of the dyeing properties, of the shade, and of the fastness properties of the applied disperse dyes occurring.

The Examples which follow illustrate the invention without its scope being limited by them. The temperatures are given in degrees Centigrade.

EXAMPLE 1

25 g of texturised polyester knitted fabric is dyed on a Multicolor dyeing machine (Pretema) with a ratio of goods to liquor of 1:12 in the following manner:

1 g of the dye mixture of the fomulae

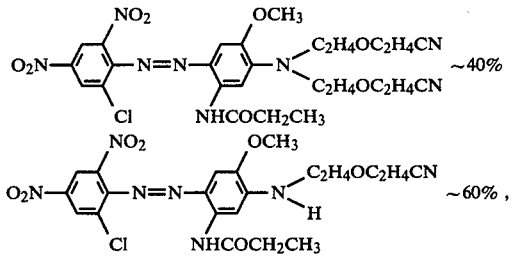

in the commercial form containing dispersing agents, is dispersed in 300 ml of water free from salt. There are then added 0.2 g of an anionic dispersing agent, 0.6 g of ammonium sulphate, 0.15 g of calcium chloride, and 1.2 g of a diphenyl carrier containing 84 percent by weight of diphenyl, and the pH value is adjusted to 4.5 to 5.5 with formic acid.

25 g of texturised polyester knitted fabric is introduced into this dye liquor, and this is heated within 20 to 30 minutes to 130° under pressure. The liquor is held at this temperature for 60 minutes. After cooling, the dyed material is rinsed with water and dried.

There is obtained a blue dyeing which displays on the surface of the material no visible precipitation of oligomers.

If the procedure is carried out as described with the exception that the 0.15 g of calcium chloride is not added to the dye liquor, there is obtained a dyeing with the sandwich effect, with the dyeing exhibiting on the surface of the material a visible precipitation of oligomers.

If the procedure as described in Example 1 is followed except that, instead of 1.2 g of the diphenyl carrier, an equal amount of one of the carriers giving in Table I is used, there are obtained fully satisfactory dyeings which display not visible precipitation of surface oligomers.

TABLE I

| Example | Carrier |
|---|---|
| 2 | benzoic acid ester (50 per cent by weight of benzoic acid phenyl ester, 50 per cent by weight of benzoic acid cresyl ester) |
| 3 | trichlorobenzene (mixture of 46% of 1,2,4-trichlorobenzene and 19% of 1,2,3-trichlorobenzene) |
| 4 | o-phenylphenol (containing 44 per cent by weight of o-phenylphenol) |
| 5 | mixture of trichlorobenzene and diphenyl (30 per cent by weight of 1,2,4-trichlorobenzene, 9 per cent by weight of 1,2,3-trichlorobenzene and 18 per cent by weight of diphenyl) |

If the procedure as described in Example 1 is followed with the exception that in addition a complexing agent, e.g. ethylenediaminetetraacetic acid, is added to the dye liquor, there is likewise obtained a dyeing which displays on the surface of the dyed material no visible precipitation of oligomers, and which also presents no difficulties in further processing.

EXAMPLE 6

25 g of texturised polyester knitted fabric is dyed at 130° for 60 minutes on a Multicolor dyeing machine. The ratio of goods to liquor is 1:12. The dye liquor consists of 300 ml of water free from salt, 0.6 g of ammonium sulphate, 0.2 g of magnesium chloride.$6H_2O$, 0.6 g of a benzoic acid carrier (50 percent by weight of benzoic acid phenyl ester and 50 percent by weight of benzoic acid cresyl ester) and a dye mixture of 0.6 g of the dye of the formula

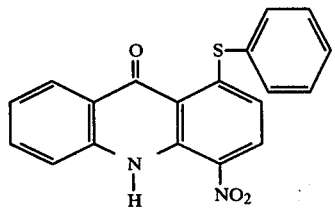

0.2 g of the dye of the formula

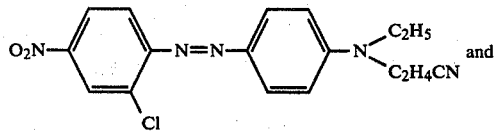

and 0.45 g of an isomeric dioxydiaminoanthraquinone dye mixture of the formula

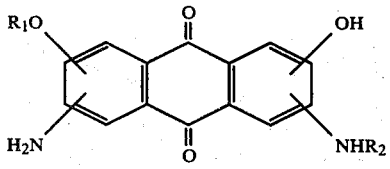

$R_1 = H$ or $-CH_3$
$R_2 = H$ or $-C_6H_5$

The dyes are used in a commercial form containing dispersing agents. The pH value is subsequently adjusted to 4.5 to 5.5 with formic acid.

After completion of the dyeing process, the dyed material is rinsed with water and dried. There occurs no visible precipitation of oligomers on the surface of the polyester material dyed in a dark brown shade.

If the procedure as described in Example 6 is followed but without making the addition of 0.2 g of magnesium chloride.$6H_2O$, patchy dyeings displaying on the surface of the dyed polyester material a clear precipitation of oligomers are obtained.

EXAMPLE 7

In a Multicolor dyeing machine, there are carried out on textured polyester knitted fabric at 130°, under high temperature conditions, dyeings with the following dye liquors, using a ratio of goods to liquor of 1:12:

Composition of the aqueous dye liquor:

2 g of ammonium sulphate per liter, 4 percent by weight, relative to the material to be dyed, of the dye mixture according to Example 1, 4 g of a carrier (diphenyl carrier with 84% of diphenyl) per liter, adjusted with formic acid to a pH value of about 5, and containing one of the following salt additions:

(a) mixture of 0.2 g of potassium chloride per liter, 0.2 g of calcium chloride per liter and 0.2 g of magnesium chloride per liter;

(b) mixture of 0.3 g of potassium nitrate per liter, 0.2 g of calcium acetate per liter and 0.3 g of magnesium nitrate per liter;

(c) mixture of 0.2 g of potassium rhodanide per liter, 0.2 g of calcium chloride per liter and 0.2 g of magnesium chloride per liter;

(d) 1.2 g of aluminium nitrate per liter;

(e) 0.8 g of magnesium sulphate per liter; or (f) mixture of 0.2 g of potassium chloride per liter and 0.3 g of magnesium nitrate per liter.

The polyester knitted fabric is introduced into the dye bath; the temperature is raised firstly to 60° and is then raised within 30 minutes to 130°. Dyeing is performed at this temperature for 60 minutes, and the bath is subsequently cooled to 70° in the course of about 10 minutes. The dyed material is afterwards rinsed with water and dried.

There are obtained with use of the dye liquors (a)–(f), which are described above, blue dyeings which display on the surface of the dyed material no visible precipitation of oligomers.

EXAMPLE 8

25 g of textured polyester knitted fabric is dyed on a Multicolor dyeing machine with a goods to liquor ratio of 1:12 in the following manner:

1 g of the dye mixture according to Example 1 is dispersed in 300 ml of water free from salt; there are then added 0.2 g of calcium chloride and 1.8 g of a diphenyl carrier containing 84 percent by weight of diphenyl. The pH value of the liquor is adjusted to 5 with acetic acid. The polyester knitted fabric is introduced, and the dye liquor is heated within 20 minutes to 100° and is held for 3 hours at this temperature. After cooling, the dyed material is rinsed with water, and reductively scoured with 5 ml of sodium hydroxide solution 36° Bé per liter, 2 g of conc. hydrosulphite per liter and 1 g of a stearylpolyaminopolyglycol ether per liter for 20 minutes at 80°. The material is subsequently rinsed and dried.

There is obtained a blue dyeing displaying no visible precipitation of oligomers on the surface of the dyed polyester material.

If dyeing is performed without the addition of the 0.2 g of calcium chloride, the dyeing exhibits the sandwich effect.

EXAMPLE 9

25 g of texturised polyester knitted fabric is dyed on a Multicolor dyeing machine with a ratio of goods to liquor of 1:12 in the following manner:

1 g of the dye mixture according to Example 1 is dispersed in 300 ml of water free from salt; there are then added 0.6 g of ammonium sulphate, 0.15 g of hexamethonium chloride [hexamethylenebis (trimethylammonium chloride)] and 1.8 g of a dipenyl carrier containing 84 percent by weight of diphenyl. The pH value of the liquor is adjusted with formic acid to 4.5 to 5.5. The dyeing is performed as described in Example 1. A dyeing showing no visible precipitation of oligomers is obtained.

If dyeing is performed as given but without the addition of 0.15 g of hexamethonium chloride, the dyeing displays white precipitations of oligomers on the surface of the dyed material.

If the procedure as described is followed except that instead of the diphenyl carrier equal amounts of the carriers listed in the following Table are used, there are obtained with the addition of 0.15 g of hexamethonium chloride in each case a clearly smaller precipitation of oligomers than that resulting without this addition. In the Table which follows is shown the evaluation of the precipitation of oligomers according to a visual scale of values:

1: no precipitation visible,

2: slight precipitation visible,

3: clear precipitation visible,

4: severe precipitation visible.

| Salt addition / Carrier | Diphenyl carrier | Trichloro-benzene carrier | Benzoic acid ester carrier | Trichloro-benzene diphenyl carrier | o-phenyl-phenol carrier |
|---|---|---|---|---|---|
| without addition of hexametho-nium chloride | 4 | 3–4 | 3 | 2 | 2 |
| with addition of hexametho-nium chloride | 1 | 1 | 1 | 1 | 1–2 |

EXAMPLE 10

25 g of texturised polyester knitted fabric is dyed at 130° for 60 minutes on a Multicolor dyeing machine. The ratio of goods to liquor is 1:12. The dye liquor consists of 300 ml of water free from salt and 1 g of a dye preparation containing a dispersing agent and a calcium complex.

The dye preparation has the following composition: 33.3% of the dye of the formula

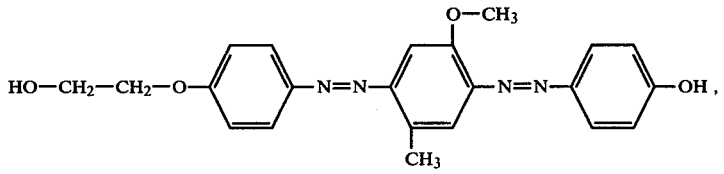

19.0% of a dispersing agent based on lignin sulphonate, 37.7% of a sulphonated condensation product from a chloromethyldiphenyl isomeric mixture and naphthalene, and 10.0% of a potassium salt of the calcium/nitrilotriacetate complex.

The pH value of the dye liquor is adjusted to 5 with acetic acid. Dyeing is performed exactly as described in Example 1. The dyed material is afterwards reductively scoured at 80° for 20 minutes with a liquor containing per liter 5 ml of sodium hydroxide solution 36° Bé, 2 g of hydrosulphite and 1 g of a stearylpolyaminopolyglycol ether. The material is subsequently rinsed and dried.

There is obtained an orange dyeing showing no visible precipitation of oligomers on the surface of the dyed polyester material.

If dyeing is performed exactly as described above but using a dye preparation which has the same composition except that it contains no calcium/nitrilotriacetate complex, the dyeing shows white precipitations of oligomers.

I claim:

1. Process for dyeing polyester fibers, or mixtures thereof with other fibers, by the exhaust method from an aqueous liquor, in which process the liquor contains 0.2 to 8.0 percent by weight, relative to the polyester fibers, of at least one alkaline-earth metal salt, aluminium salt or organic ammonium salt of a mono- or polyvalent aliphatic organic acid or of a mono- or polyvalent inorganic acid.

2. Process according to claim 1, wherein the liquor contains an alkaline-earth metal salt or aluminium salt of a mono- or polyvalent aliphatic organic acid or of a mono- or polyvalent inorganic acid.

3. Process according to claim 1, wherein the liquor contains an organic ammonium salt of a mono- or polyvalent aliphatic organic acid or of a mono- or polyvalent inorganic acid.

4. Process according to claim 1, wherein the aqueous liquor contains 0.5 to 4.0 percent by weight, relative to the material, of at least one alkaline-earth metal salt, aluminium salt or organic ammonium salt of a mono- or polyvalent aliphatic organic acid or of a mono- or polyvalent inorganic acid.

5. Process according to claim 1, wherein the dyeing is performed at a temperature of above 100° C., under pressure.

6. Process according to claim 1, wherein the metal salt used are the magnesium, calcium, barium, aluminium or organic ammonium salts of hydrochloric acid, hydrobromic acid, hydrofluoric acid, nitric acid, sulphuric acid, phosphoric acid, formic acid, acetic acid or thiocyanic acid.

7. Process according to claim 1, wherein there is used an alkaline-earth metal salt of a monovalent inorganic or organic aliphatic acid.

8. Process according to claim 1, wherein the aqueous liquor contains an alkaline-earth metal salt, aluminium salt or organic ammonium salt of a complex-forming organic acid.

9. Process according to claim 1, wherein the dye liquor contains auxiliaries and dispersing agents.

10. Aqueous dye liquor for performing the process according to claim 1, which liquor contains at least one disperse dye and at least one alkaline-earth metal salt, aluminium salt or organic ammonium salt of a mono- or polyvalent aliphatic organic acid or of a mono- or polyvalent inorganic acid.

11. The polyester material, or mixtures thereof with other fibres, dyed according to the process of claim 1.

12. Process according to claim 5, wherein the dyeing is performed at a temperature in the range of 120° to 140° C.

13. Process according to claim 7, wherein the metal salt is calcium chloride or magnesium chloride.

14. Process according to claim 8, wherein the metal salt is a salt of ethylenediaminetetraacetic acid or nitrilotriacetic acid.

* * * * *